United States Patent [19]

Bartmann

[11] 4,324,369

[45] Apr. 13, 1982

[54] DOUBLE DRUM WINDER

[75] Inventor: Bernhard Bartmann, Heindenheim, Fed. Rep. of Germany

[73] Assignee: J. M. Voith GmbH, Fed. Rep. of Germany

[21] Appl. No.: 165,954

[22] Filed: Jul. 3, 1980

[30] Foreign Application Priority Data

Jul. 14, 1979 [DE] Fed. Rep. of Germany ..... 2928543

[51] Int. Cl.[3] ..... B65H 17/08

[52] U.S. Cl. ..... 242/66

[58] Field of Search ..... 242/66, 64, 65, 67.1 R, 242/56 A, 56.2, 67.2, 67.3 R

[56] References Cited

U.S. PATENT DOCUMENTS

| | | | |
|---|---|---|---|
| 2,877,959 | 3/1959 | Aaron | 242/66 |
| 3,345,010 | 10/1967 | Egan | 242/66 |
| 3,406,925 | 10/1968 | Waterhouse | 242/66 |
| 4,135,674 | 1/1979 | Bartmann | 242/66 |

*Primary Examiner*—Edward J. McCarthy

*Attorney, Agent, or Firm*—Ostrolenk, Faber, Gerb & Soffen

[57] ABSTRACT

The disclosure concerns a double-drum winder for winding and for then ejecting a wound roll of web material and transferring the same to a delivery table. Adjacent to the double-drums on which the roll is wound there is a transfer table which is movable between a horizontal position where it can receive the wound roll from the double drums and a vertical position where the upstanding table blocks undesired movement of the wound roll past the transfer table. An ejecting device moves the wound roll to the transfer table. The transfer table is on a swivel mount so placed that the transfer table pivots away from the drums as it swivels up from its horizontal to its vertical positions. The swivel axis of the transfer table is on a swivel mount that is supported for limited vertical movement. A lock holds the swivel mount vertically up and it is spring-biased down against the lock. A fluid operated linear actuator moves the transfer table between its horizontal and vertical orientations and also pulls up the swivel mount.

20 Claims, 2 Drawing Figures

15
24
27
28
25
19
18
23
22
20
21
17
6
30
10
8
9
24
25
26
II
16
19
S
7
21
22
II
23
18
28
27
20
29
15
2
1
3
12
14
11
4
13
5

DOUBLE DRUM WINDER

BACKGROUND OF THE INVENTION

The present invention relates to a double-drum winder having a device for ejecting the wound roll onto a transfer table, wherein the table is swingable between a substantially horizontal and a substantially vertical position around an axis parallel to the axis of the wound roll in order to transfer the roll, at approximately the same height as the table, to subsequent devices.

In roll-changing devices for paper webs, in which the roll being wound is supported on two supporting drums, it is known to lift the completely wound roll by means of one end of double levers that act on both ends of the winding core, to cut the wound web and, by means of compressed air, to place the cut web against a new winding core, which is fed onto the supporting drum by the other end of the double lever. The new winding core carries the web along and winds it up. The finished, wound and lifted roll is simultaneously placed by means of the double levers on a delivery table. (See German Unexamined Application for Patent Offenlegungsschrift No. 26 49 289, corresponding to U.S. Pat. No. 4,135,674). Such an automatic roll changing device uses rolls either with a winding shaft that is flexurally rigid or with a winding shaft that is not flexurally rigid. However, it is generally desirable, in order to expand the operating possibilities of a machine to develop it in addition also for winding a roll without any winding shaft. For this purpose, it is known to provide a transfer table and a protective device to protect against wound rolls jumping off the supporting drums. When such a machine has a compact construction, which is desirable for financial reasons, certain structural difficulties result. When the movable transfer table and the roll changing double lever are close to each other, which is necessary in a compact arrangement, they may interfere with each other. In addition, a closable operating passage must be provided behind the supporting drums.

SUMMARY OF THE INVENTION

The object of the present invention is to create a double-drum winder which is simple and permits a compact construction of the machine. This should be provided even when there is simultaneous provision of the roll-changing systems, and both with automatic changing of rolls with winding shafts of flexural rigidity, via double levers, and with changing of rolls wound on winding shafts which are not flexurally rigid.

According to the present invention, the aforementioned type of double-drum winder includes a transfer table that can be lowered from its substantially vertical position to a horizontal position. In the vertical position, the table serves as a protective shield against a wound roll jimping off the transfer table. A double-drum winder which is developed with a transfer table in accordance with the invention can be compact. It can be provided with an automatic roll-changing system in which the winding shafts are lifted out and inserted by means of double ended levers which act on both ends of the winding core. The lowering of the transfer table to the horizontal position makes this possible, as sufficient space is then provided for the transfer by the double ended levers of a completely wound roll from the supporting drums onto a transfer table and for the simultaneous transfer of a new empty winding core onto the supporting drums. Furthermore, the invention permits free access to the winding station, completely unimpeded by the transfer table. In its raised position the transfer table serves as protective device during the winding process. In combination with laterally applied door-like closures in the region between the supporting drums and transfer table support, this space can be fully secured.

To lock the transfer table in the vertical orientation, at least one lever can be swung into the path of descent of the swivel bearing for the transfer table and the transfer table to block movement of the transfer table out of a vertical orientation.

A substantially vertically acting, linear actuator acts on a lever that is connected with the transfer table. The actuator is connected at a distance from the swivel axis of the lever. The swivel mount of the transfer table can be locked in its upper position so as to secure it against descent. It is possible to use the linear actuator both for swinging the transfer table and for simultaneously lowering it, so that no additional drive for the lowering is required. In general, such a linear actuator is arranged on both ends of the transfer table.

A stop for preventing further swinging of the transfer table beyond its vertical position away from the supporting drum is provided. In the vertical position of the transfer table, its center of gravity lies on the side of the swivel axis away from the supporting drums, and the point of attack of the linear actuator lies on the side of the swivel axis toward the supporting drums. Guide ledges are preferably used as stops against which the transfer table rests upon lowering.

A stop which yields under spring action within small limits serves as the upper limit for the vertically displaceable swivel mount for the transfer table.

The lock is so arranged that in its upper position, the swivel mount is urged under spring pressure against the lock when the lock is inserted. After swinging of the transfer table back into the vertical position, the linear actuator pulls the table, against the spring pressure, into the upper limit position and the lock can be swung out from supporting the table without contact with the table or its swivel support.

BRIEF DESCRIPTION OF THE DRAWINGS

One illustrative embodiment of the invention will be described below with reference to the drawings, in which.

DESCRIPTION OF A PREFERRED EMBODIMENT

Figures 1, 2:
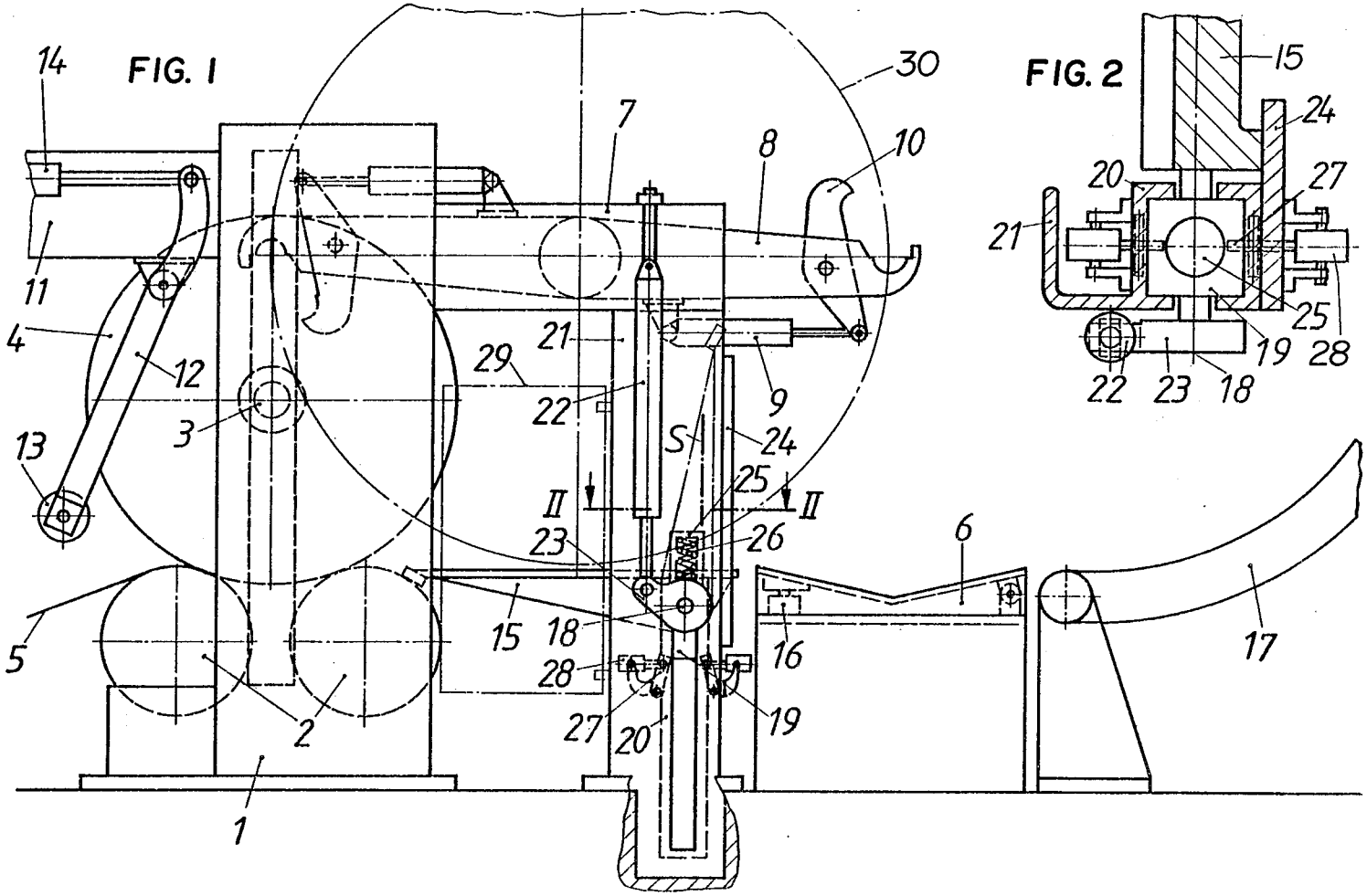
FIG. 1 shows a schematic side view of a double-drum winder with its transfer table in the horizontal position.
FIG. 2 shows on a somewhat larger scale a section along the line II—II of FIG. 1, but with the transfer table in the vertical position.

The motor driven supporting drums 2 of a drum roller are arranged in a frame 1. The roll 4 of the incoming paper web 5, which is wound on a winding core 3, is shown after it has reached the desired diameter and is ready to be transferred to the lift table 6 of a delivery station. The lengthwise rails 7 support double levers 8 which swivel at the middles of the levers. The levers have holding clamps 10 arranged on their opposite ends. The clamps are actuated by actuators 9 for automatically changing the roll, as described in further detail in German Unexamined Application for Patent (Offenlegungsschrift) No. 26 49 289. Such an automatic change of rolls is possible only when using winding shafts of flexural rigidity. However, if rigid shafts are not used for the web winding but instead, for example, winding tubes which can be clamped axially by means of an expansion mandrel and which are placed manually on the supporting drums 2 are used, then the change of rolls cannot take place using the aforesaid automatic change mechanism.

Instead, the full roll must be pushed out of the two supporting drums 2 in known manner. For this purpose, there is an ejection device which is comprised of double levers 12 pivoted on both sides to lengthwise rails 11. The levers 12 support an ejector drum 13 between their downwardly extending lever parts. Actuators 14 act on the upwardly extending parts of the levers 12. By means of this arrangement, the full roll 4 is pressed onto the transfer table 15. From there, it passes onto the lift table 6. The table 6 can be raised on one side by the hydraulic actuator 16. The roll 4 passes from the table 6 onto the lowering table 17.

The transfer table 15 is swivellingly mounted at 18 around a horizontal axis. In its vertical position, shown in dot-dash line, the table 15 serves as a protective device against the jumping of rolls off the double-drum bed. Since the automatic roll changing device having the double levers 8 would however collide with the swingable transfer table 15, that table can be lowered from its vertical position. For this purpose, each swivel bearing is supported in slide members 19 which can be displaced vertically in guides 20 arranged on both sides of the machine.

For causing the swinging of the transfer table 15, there are vertically acting actuators 22 which are suspended from the lengthwise rails 7. The actuators 22 act on levers 23 which are connected with the transfer table 15. Upon the swinging of the transfer table from its horizontal position into the vertical position shown in dot-dash line, the transfer table comes against guide ledges 24. The table 15 is raised by the actuators 22 against the pressure of the spring 26 arranged in the spring retainers 25 that are fastened in each stand 21 to such an extent that the locking levers 27 can be swung in beneath the slide members 19 without contacting the members 19. The lock levers 27 are swung in by means of the displacement cylinders 28. Upon the decrease of the fluid pressure in the actuators 22, the slide members 19 of the transfer table 15 are pressed by the springs 26 against the locking levers 27.

For lowering of the transfer table 15, it is first raised again against the pressure of the springs 26, the locking levers 27 are swung back and the table 15 is moved downward by the actuators 22. In the vertical position of the transfer table, since the center of gravity S lies on the side of the swivel axis 18 facing away from the supporting drums 2, the transfer table slides downward on the slide guides 20. Coupled with the downward swiveling of the transfer table, the downward sliding of the slide members causes the transfer table 15 to come out of the circular swing path 30, shown in dot-dash line, of the holding clamps 10 which are fastened to the double levers 8.

The doors 29 enable the space between the supporting drums 2 and the transfer table in the vertical position to be completely closed off against undesired shifting of the wound rolls off the transfer table.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A double-drum winder for winding a roll of web material and for ejecting a wound roll of web material, the winder comprising:

drums for being driven to rotate and on which a roll of web material is to be wound;

a transfer table positioned next to the drums and to which a wound roll is to be transferred;

ejecting means for ejecting a wound roll off the drums and for moving the wound roll onto the transfer table;

the transfer table being pivotally mounted on a pivot axis, which is generally parallel to the axis of the wound roll, whereby the transfer table can be pivoted between a horizontal position at which the transfer table is positioned to receive an ejected roll, and a vertical position at which the transfer table serves as a protective shield against movement of a roll past the vertical transfer table.

2. The double-drum winder of claim 1, wherein the ejecting means comprises a swivelable double ended lever, which is swivelable around an axis that is located along the length of the double ended lever, the axis being oriented generally parallel to and offset from the axis of the roll; the double ended lever having roll engaging supports at the end portions thereof away from the axis thereof; the double ended lever following a swivel path around its axis such that the double ended lever will cause a roll supported on a roll engaging support thereof to intersect the transfer table when the transfer table is at the vertical position, but which will cause the same roll to avoid intersecting the transfer table when the transfer table is at the horizontal position thereof.

3. A double-drum winder according to claim 1, wherein the transfer table pivot axis is approximately at the height of the drums.

4. The double-drum winder of claim 1, wherein the transfer table pivot axis is located spaced away from the drums and the transfer table is pivotable up and away from the drums to the vertical position thereof and is pivotable down and toward the drums to the horizontal position thereof.

5. The double-drum winder of claims 1 or 4, wherein the pivot axis of the transfer table is on a swivel mount, and the swivel mount is movable vertically with respect to the drums;

locking means for locking the transfer table swivel mount in an upraised vertical position thereof.

6. The double-drum winder of either of claims 1 or 4, further comprising transfer table moving means for pivoting the transfer table to the horizontal and vertical positions thereof.

7. The double-drum winder of claim 6, wherein the transfer table moving means comprise a lever connected with the transfer table and a substantially vertically acting, linear actuator connected to the lever at a distance from the pivot axis of the transfer table.

8. The double-drum winder of claim 7, wherein the linear actuator is a fluid operated actuator.

9. The double-drum winder of claim 7, wherein the linear actuator is attached to the moving means lever at a location that is on the side of the pivot axis of the transfer table that is toward the drums.

10. The double-drum winder of claim 7, further comprising an upper stop positioned for blocking further pivoting of the transfer table beyond the vertical position thereof when the transfer table has been moved to the vertical position.

11. The double-drum winder of claim 6, further comprising a lower stop against which the transfer table rests upon lowering thereof to the horizonal position thereof.

12. The double-drum winder of claim 6, further comprising an upper stop positioned for blocking further pivoting of the transfer table beyond the vertical position thereof when the transfer table has been moved to the vertical position.

13. The double-drum winder of claim 12, wherein the transfer table has a center of gravity when the transfer table is in its vertical position, and the center of gravity is on the side of the pivot axis of the transfer table that is away from the drums.

14. The double-drum winder of claim 13, wherein the transfer table moving means comprise a lever connected with the transfer table and a substantially vertically acting, linear actuator connected to the lever at a distance from the pivot axis of the transfer table.

15. The double-drum winder of claim 5, further comprising a swivel mount stop for stopping upward motion of the swivel mount, and the swivel mount stop being spring-yieldable.

16. The double-drum winder of claim 15, wherein the locking means is so placed that the swivel mount lies against the locking means when the swivel mount is upraised and the locking means is swung into the position to block the swivel mount.

17. The double-drum winder of claim 15, further comprising a vertical slide guide for the swivel mount, for enabling and controlling vertical shifting of the swivel mount.

18. The double-drum winder of claim 5, wherein the locking means comprise a locking lever swingable into the path of descent of the transfer table swivel mount for blocking vertically downward movement of the swivel mount and for also blocking movement of the transfer table out of the vertical position.

19. The double-drum winder of claim 18, wherein the locking means is so placed that the swivel mount lies against the locking means when the swivel mount is upraised and the locking means is swung into the position to block the swivel mount.

20. The double-drum winder of claim 5, further comprising a vertical slide guide for the swivel mount, for enabling and controlling vertical shifting of the swivel mount.

* * * * *